United States Patent [19]

Holmes

[11] Patent Number: 5,000,436

[45] Date of Patent: Mar. 19, 1991

[54] ROTARY STACKER AND METHOD

[75] Inventor: Michael Holmes, Cornwall, England

[73] Assignee: Paper Converting Machine Company, Green Bay, Wis.

[21] Appl. No.: 486,900

[22] Filed: Feb. 26, 1990

[51] Int. Cl.[5] ..... B65H 29/40

[52] U.S. Cl. ..... 271/178; 271/220; 271/314; 414/794.8; 414/907

[58] Field of Search ..... 271/177, 178, 220, 207, 271/198, 214, 215, 217, 219, 306, 314; 414/794.8, 907

[56] References Cited

U.S. PATENT DOCUMENTS

| | | | |
|---|---|---|---|
| 582,593 | 5/1899 | Waite | 271/178 |
| 1,845,895 | 12/1930 | Van Voorhis . | |
| 3,224,757 | 12/1965 | Parke et al. | 271/314 X |
| 3,304,084 | 2/1967 | Ashton | 271/314 X |
| 3,342,481 | 9/1967 | Kaplan | 271/178 |
| 3,514,101 | 5/1970 | Gatti | 271/220 |
| 3,682,473 | 8/1972 | Kuyt | 414/907 X |
| 3,740,049 | 6/1973 | Fischer . | |
| 3,805,971 | 4/1974 | Behrens et al. | 414/907 X |
| 3,871,539 | 3/1975 | Nikkel | 414/794.9 X |
| 4,349,185 | 9/1982 | Small et al. . | |
| 4,509,739 | 4/1985 | Kurokawa | 271/215 X |
| 4,558,859 | 12/1985 | Duke et al. | 414/907 X |
| 4,625,957 | 12/1986 | DuFresne . | |
| 4,640,506 | 2/1987 | Luperti et al. | 414/794.9 X |

FOREIGN PATENT DOCUMENTS

| | | | |
|---|---|---|---|
| 48705 | 5/1987 | European Pat. Off. | 271/220 |
| 48111 | 11/1981 | Japan | 414/794.8 |

*Primary Examiner*—H. Grant Skaggs
*Assistant Examiner*—Druzbick
*Attorney, Agent, or Firm*—Tilton, Fallon, Lungmus & Chestnut

[57] ABSTRACT

A rotary stacker and method wherein a stream of web units such as napkins is advanced along a longitudinally extending path in longitudinally spaced relation toward and over a magazine, each napkin being pressed into the magazine by cams applying pressure at a plurality of longitudinally spaced areas over the magazine and orienting the cams so as to remove the pressure on the upstream cam just prior to the entry of the leading edge of a unit subsequent to the one being pressed and while maintaining the pressure on the previously pressed unit by the downstream cams.

11 Claims, 4 Drawing Sheets

ROTARY STACKER AND METHOD

BACKGROUND AND SUMMARY OF INVENTION

This invention relates to a rotary stacker and method and, more particularly, to a stacker useful in packing a sequence of web units (such as napkins) into a stack.

In the past, stacking of napkins, for example, has been achieved through the use of reciprocating movement (U.S. Pat. No. 1,845,895) or orbital movement (U.S. Pat. Nos. 3,740,049; 4,349,185; 4,625,957). These were speed limiting because the packer fingers or plunger had to move out of the way before another unit could be packed. With even the fastest packer mechanisms, a discrete time was involved after the packer mechanism had reached the end of its "throw", i.e., bottom dead center.

According to the invention, this discrete time lag no longer is present. The plurality of cam means of the invention is "out of the way" virtually simultaneously with the end of the throw. Moreover, the invention provides an additional new result not heretofore possible: while the next succeeding unit is entering the packing area, the preceding units are held down by some of the cam means downstream of the path of travel of the units into the packing area. And this advantageous "hold-down" pertains right up to the time another packing cycle starts.

Other objects and advantages of the invention may be seen in the ensuing specification.

The invention is described in conjunction with an illustrative embodiment in the accompanying drawing, in which FIG. 1 is a fragmentary side elevational view of apparatus employed in the practice of the invention featuring the cam means at the lower right;

DETAILED DESCRIPTION

Figure 1:
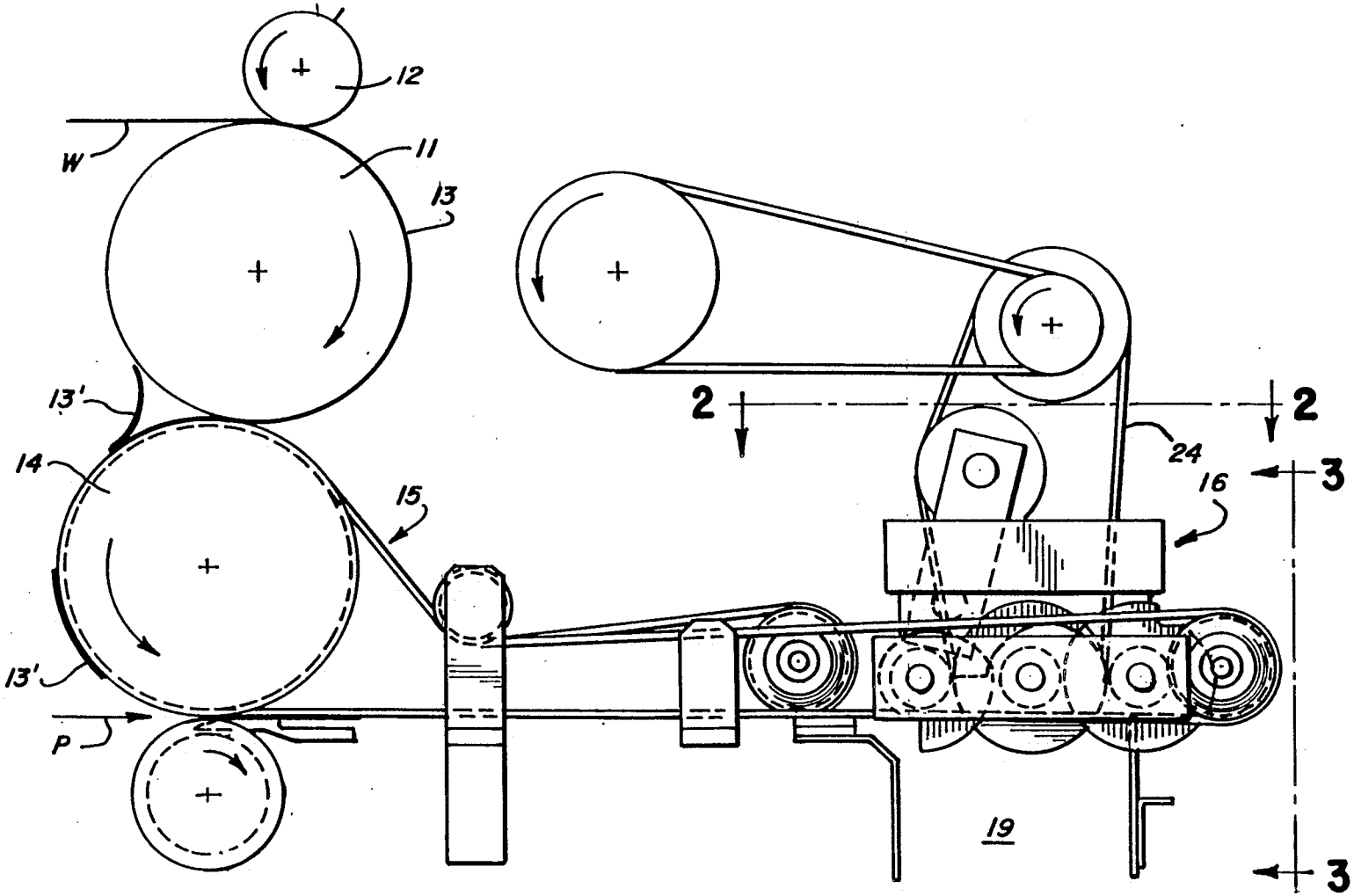
Figure 2:
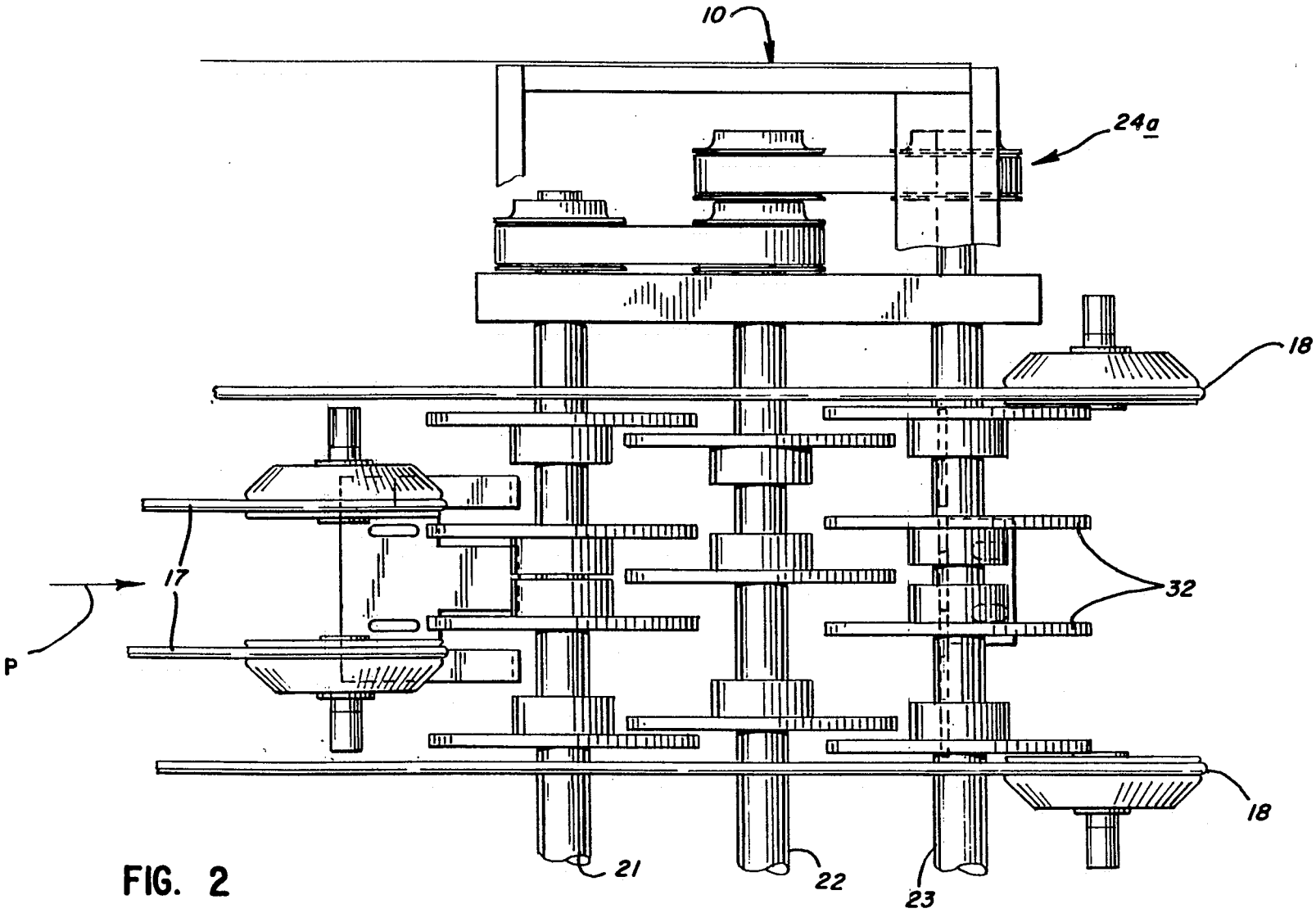
FIG. 2 is a fragmentary, enlarged top plan view of a portion of the apparatus of FIG. 1 such as would be seen along the sight line 2—2 of FIG. 1.

In the illustration given and with reference first to FIG. 2, the numeral 10 designates generally a frame for the machine which, in accordance with conventional converting practice, consists of two sturdy side frames integrated with cross members so as to rotatably support a number of rolls, shafts and the like. The frame defines a longitudinally extending path P (see the left sides of FIGS. 1 and 2) in which a web W advances (see the upper left hand part of FIG. 1).

As the web W advances, it is partially wrapped around an anvil roll 11 against which a knife roll 12 operates to provide discrete web segments 13. The roll 11, again in conventional fashion, serves as a folding roll in conjunction with a vacuum roll 14 to develop transversely folded web segments as at 13'. These overlie a belt system generally designated 15 which strips the web segments 13' sequentially from the vacuum folding roll 14 and advances them toward a packing or stacking station generally designated 16.

The folded segments 13' are initially advanced by the belts 17 (see the left hand portion of FIG. 2) and then transferred to belts 18 (see the right hand portion of FIG. 2) which grip the units along the longitudinal edges thereof. The web units 13' are advanced by the belts 18 into a position over a magazine 19 at which time they are stripped by means of a plurality of cam means arrayed as at 20—see the central bottom portion of FIG. 2.

Figure 3:
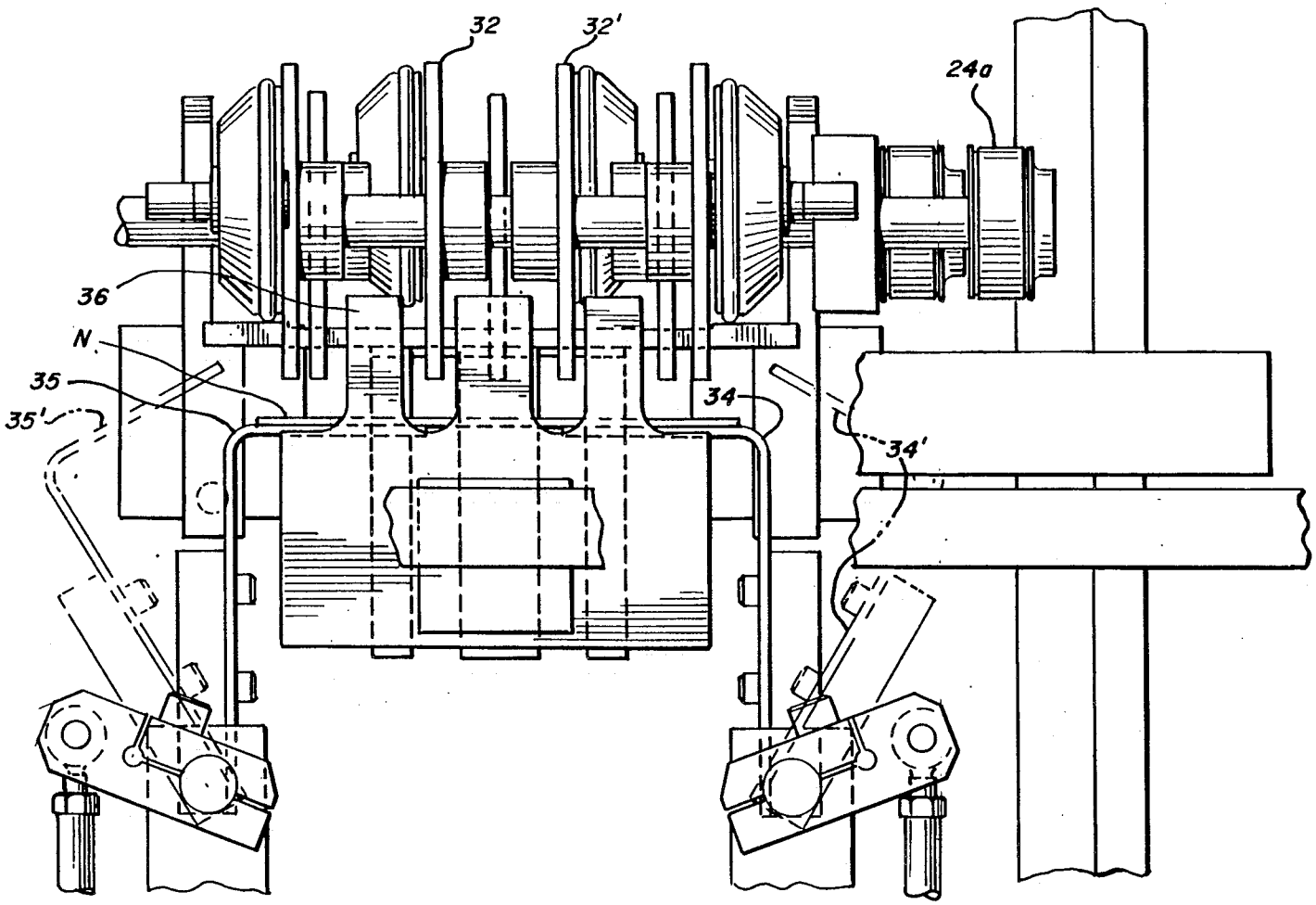
FIG. 3 is a fragmentary, enlarged front elevational view of the portion of the apparatus of FIG. 1 essentially as seen along the sight line 3—3 of FIG. 1.
Figure 4:
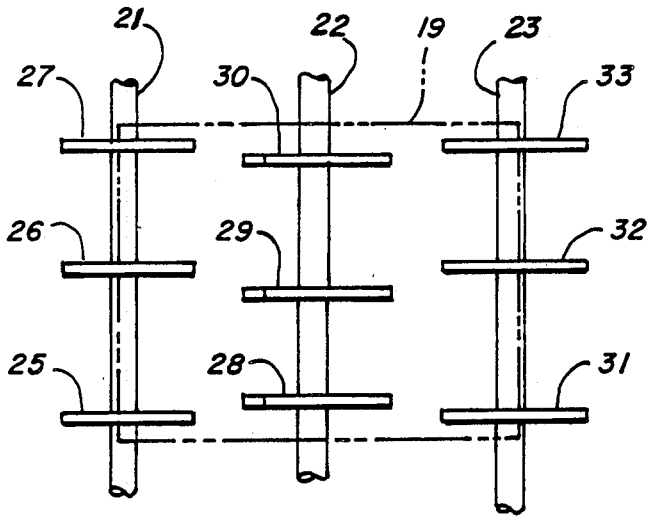
FIG. 4 is a schematic top plan view of the operative elements of FIG. 2.

For the purpose of ease of explaining the operation of the cam means, a schematic display is seen in FIG. 4 where the cams are "spread" for clarity of understanding. Also only three cams are shown on each shaft—as contrasted to the four on the upstream and downstream shafts 21, 23 of FIGS. 2 and 3.

Referring now to FIG. 4, the numeral 19 depicts the magazine in chain line and over it, three shafts 21, 22 and 23 which are suitably journaled in the frame 10. The drive for the shafts is generally designated 24 and is seen in the upper portion of FIG. 1 and the three shafts are connected by belts as at **24*a* (see FIGS. 2 and 3**).

Mounted on each shaft are three lobular members which, in the illustrated embodiment, appear to look very much like cams and which I refer to hereinafter as "cams" or "cam means". The cams on shaft 21 are designated by the numerals 25, 26 and 27, those on shaft 22 as 28, 29 and 30 while those on shaft 23 are designated 31, 32 and 33. It will be noted that the outboard cams 25, 27 on shaft 21 and 31, 33 on shaft 23 are further outboard than the outboard cams 28, 30 on shaft 22. This is done in order to accommodate the size of the cams in a restricted area as can be appreciated from the depiction in FIG. 2. The same offset between center cam 29 on shaft 22 and the center cams 26 and 32 on shafts 21 and 23 also occurs in order to avoid interference. This also can be seen in FIG. 3 where there are a pair of center cams in the most downstream position as at 32, 32'—also designated in FIG. 2.

Figure 5:
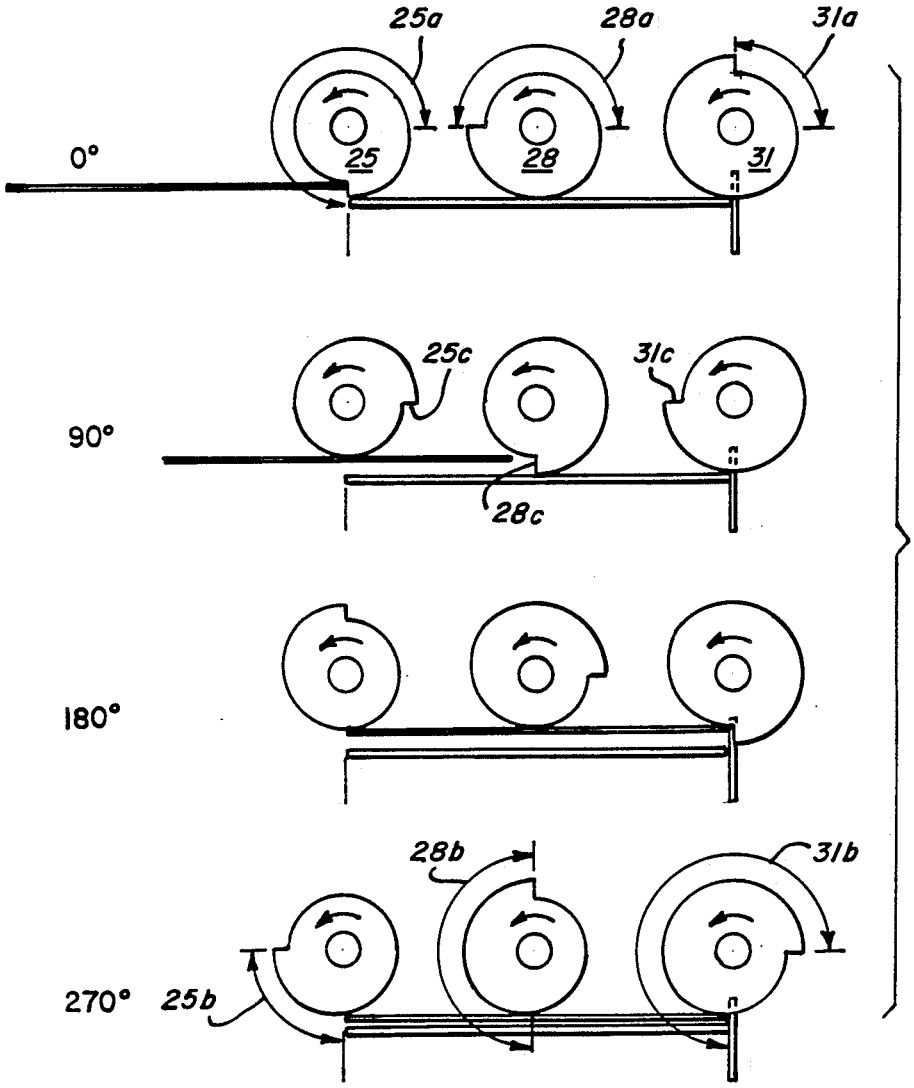
FIG. 5 is a sequence of schematic side elevational view showing the position of the cam means during various portions of the cycle.

Reference is now made to FIG. 5 wherein the sequencing of the rotation of the cams is depicted and will now be described.

OPERATION

FIG. 5 shows the cam orientation in different stages, viz., 0°, 90°, 180° and 270°. As a napkin approaches the magazine 19, the cams will be as illustrated at the 0° showing—with the high point of cam 25 just clearing the leading edge of the napkin. The previous napkins are held down by the high lobes (maximum radii) on each cam. The leading edges of the cams 28 and 31 are also timed to just clear the leading edge of the napkin as it reaches each cam—see the 90° and 180° showings.

While the napkin is being driven past cams 25 and 28, a dwell radius exists equal to the height of the napkin in the drive belts 18. Once the leading edge of a napkin reaches a point over the downstream end of the magazine, a slow increase in cam height occurs on each cam equally, pushing the napkin out of the drive belts down into the magazine—see the 270° showing. This takes approximately one-half of that portion of the rotation of the cam during the space between one napkin and the next—compare the 270° and 0° showings. As the next napkin approaches, the cams will again be as in the 0° showing—with the previous napkin held down by the high lobes (maximum radii) on the cams 28 and 31, and the cycle is repeated.

More generally, the invention includes advancing napkins or other web units in sequence along a longitudinally extending path P into a packing station 16. This includes a plurality of rotary cam means 25–33 arranged both longitudinally and transversely above the path P. Each of the cam means has a first peripheral portion—as viewed in the direction of cam rotation—adapted to lie above the path P whereby a napkin can advance in the path without interference from the cam means. This first peripheral portion relative to the cam 25 is designated 25*a* in the 0° position in FIG. 5 and, because of the geometry involved, extends over about 270° of the cam periphery or profile.

In the case of the cam means 28, this first peripheral non-protruding portion extends over approximately 180° and is designated 28*a*. In similar fashion, the non-protruding peripheral portion on the cam 31 extends over about 90° and is designated 31*a*.

Each cam has a second peripheral portion which is adapted to protrude into the path P whereby the cams are adapted to strip a napkin from the belts 18. This can be best appreciated from the 270° showing in FIG. 5 where the cams 25, 28 and 31 are in the position to start the stripping and pushdown of the napkin which now lies over but within the confines of the magazine 19. In the case of the cam 25, this second peripheral portion 25*b* has an extent of about 90°. Relative to the cam 28, the second peripheral portion has an extent of about 180° with half of the second peripheral portion being used for stripping and pushdown and the remaining half for hold down—as can be appreciated from a consideration of the 0° showing in FIG. 5 relative to the cam 28.

In the case of the third set of cam means 31, 32 and 33, this second peripheral portion 28*c* has an extent of about 270°. 90° of this 270° is used for stripping and pushdown whereas the remaining 180° is used for hold down as can be appreciated from a comparison of 0°, 90° and 180° showings in FIG. 5 relative to the most downstream set of cams (designated 31). Thus, this second peripheral portion not only strips the napkins from the belts 18 but also, in the case of the cams 28, 31, serves to hold the stripped napkins in the magazine below the path P.

It will be noted that each of the cam means has a relatively abrupt transition as at 25*c*, 28*c* and 31*c* between the end of the second peripheral portion and the beginning of the first peripheral portion.

From a consideration of the showings in FIG. 5 it will be seen that the rotation of the various cams is sequenced to remove the transition 25*c*, 28*c* or 31*c* as the case may be, from the path just prior to the time the leading edge of a napkin reaches each one of the cam means. This can be appreciated from the orientation of the cam 25 in the 0° showing, the orientation of the cam 28 in the 90° showing and the orientation of the cam 31 in the 180° showing.

Summarizing the operation, I stack web units such as napkins or the like by advancing a stream of web units 13' along a longitudinally extending path P with the trailing edge of each unit being spaced downstream from the leading edge of the next or subsequent unit—with this advance being toward and over the magazine 19. Each unit is sequentially pressed into the magazine by applying pressure thereto at a plurality of longitudinally spaced areas. As illustrated, there is one upstream in the path of unit travel, one central and one downstream. I then remove the upstream pressure just prior to the entry of the leading edge of a unit subsequent to the one being pressed into the magazine in the upstream area while maintaining the pressure on the one unit in the magazine in the downstream area or areas.

I then remove the downstream pressure just prior to entry of the leading edge of the subsequent unit into the downstream area and simultaneously apply magazine introducing pressure on the subsequent unit by all cams when the subsequent unit is completely over the magazine. At 0° in FIG. 5, the pervious napkin is being pushed down. It is held down at 90° and 180° while at 270° the start of pushdown of the next napkin occurs.

CAM DESIGN

The cams are in the form shown in FIG. 5 and are so designed that the revolution of each cam is equal to the length of one folded napkin plus the space to the next napkin, i.e., one pitch length on the belts 18. The average diameter of the cams is calculated so that the peripheral speed of the cams approximately equals the velocity of the napkins. The form of the cams 25, 26 and 27 is the same for each of these—but different from the cams 28–30 and 31–33. However, each of the cams 28–30 are generally the same but again different from the cams 31–33 which in turn, are again generally the same relative to each other, but not to the other cams. Typically, three or more cams are mounted on each of the cross shafts per lane and the number of arrangements can be determined from the character of the web unit being handled. In some instances, it is advantageous to have additional cams centrally along the length of each shaft to make sure that any building or entrapped air is removed.

Although spiral geometries are shown in the illustration given, other shapes such as lobular or eccentric may also be used to provide advantageous packing motions. In practice, different geometries are chosen for the different cam locations based upon product geometry, stiffness and conveying means. For example, the leading edge can be pushed down as the napkin moves through the magazine or alternatively, the trailing edge pushed down first to increase the gap for the next napkin.

Summarizing, the basic cam outside diameter was designed to equal, within the space limitations of the cams, the web velocity. The cam throw (maximum radius) was designed to be just sufficient to push the product clear of count fingers 34 when the latter are engaged to support a napkin N—as seen in solid line in FIG. 3. The retracted portions are seen in dashed line and designated 34' and 35'. The numeral 36 in FIG. 3 designates the end stop in the magazine.

The form of the cams consists of the major radius (pack down), the minor radius (product clearance), with a blend radius to join the two. The length of the minor radius is increased from the rear cam to the front cam to suit the leading edge of the product as it enters the magazine. All three cam forms then pack down the napkins simultaneously. The outside, center and rear cams have been further relieved to achieve additional space for the count fingers 34, 35 to engage the pack.

The number of cams is chosen to give an evenly spread push down with the minimum number of cams, the most important area to cover being the edges, to ensure efficient clearing from the delivery belts and the rear of the magazine to ensure that the previous napkin is cleared for the next napkin to enter. However, it is also important to have the center cams operate to reduce the degree of bowing between cams when packing soft napkins.

While in the foregoing specification a detailed description of an embodiment of the invention has been set down for the purpose of illustration, many variations in the details hereingiven may be made by those skilled in the art without departing from the spirit and scope of the invention.

I claim:

1. Apparatus for stacking flexible web units such as napkins or the like, comprising a frame, belt means on said frame for advancing said units along a longitudinally-extending path in longitudinally spaced relation, magazine means on said frame adjacent the downstream end of said path for sequentially receiving said units, a plurality of longitudinally spaced rotary pressing means above said magazine means, and phasing means for said pressing means to actuate all of said pressing means simultaneously to strip a unit from said belt means and thereafter maintain each of the downstream of said plurality of pressing means in pressure contact with a just-stripped unit while returning the most upstream pressing means to condition for stripping a subsequent unit from said belt means when the leading edge of said subsequent unit is about to engage said most upstream pressing means and to return each said downstream pressing means to condition for stripping when said subsequent unit leading edge is about to engage each said downstream pressing unit.

2. The apparatus of claim 1 in which said pressing means includes cam means and said phasing means includes the profiles of said cam means and the orientation of said cam means.

3. The apparatus of claim 1 in which said plurality of pressing means includes at least three longitudinally spaced, transversely-extending shafts, a plurality of transversely-spaced cam means on each shaft, said phasing means being operative to return each of said downstream pressing means sequentially to condition for stripping when said subsequent unit leading edge is about to engage each said downstream pressing unit.

4. Apparatus for stacking napkins or the like comprising a frame defining a longitudinally extending path, a plurality of belt means on said frame adjacent the longitudinal side of said path for gripping sequentially a stream of longitudinally spaced napkins and advancing the same in said path, magazine means on said frame below the downstream end of said path for sequentially receiving said napkins, at least three longitudinally-spaced shafts rotatably mounted on said frame above said path and above said magazine means, means on said frame for rotating said shafts, and at least three cam means mounted on each shaft, one adjacent each belt means and one intermediate thereof, each said cam means having a first peripheral portion in the direction of rotation thereof adapted to lie above said path whereby a napkin can advance in said path without interference from said cam means, each said cam means having a second peripheral portion trailing said first peripheral portion in the direction of rotation and adapted to protrude into said path whereby said cam means are adapted to strip a napkin from said belt means and thereafter hold a stripped napkin in said magazine, each cam means having a relatively abrupt transition between the trailing end of said second peripheral portion and the beginning end of said first peripheral portion, said cam means being oriented on said shafts to remove said transitions from positions in said path just prior to the leading edge of a unit reaching said positions.

5. The apparatus of claim 4 in which cut-off roll means are mounted on said frame upstream of said belt means, said cam means rotating at a multiple of the speed of said cutoff roll means.

6. The apparatus of claim 4 in which each of said cam means has a peripheral extent equal to the length of one napkin plus the space between napkins.

7. The apparatus of claim 4 in which three shafts are mounted on said frame in longitudinally spaced relation above said magazine means, the second peripheral portion of the downstream cam means having a longer radii than the second peripheral portion of the upstream cam means.

8. The apparatus of claim 7 in which each shaft is equipped with three identical cam means in transversely spaced relation per lane.

9. The apparatus of claim 8 in which said transition includes a generally radially extending step between second and first peripheral portions.

10. Apparatus for stacking napkins or the like comprising a frame defining a longitudinally extending path, a plurality of belt means on a frame adjacent the longitudinal sides of said path for gripping sequentially a stream of longitudinally spaced napkins and advancing the same in said path, magazine means on said frame below the downstream end of said path for sequentially receiving said napkins, at least three longitudinally-spaced shafts rotatably mounted on said frame above said path and above said magazine means, at least three cams mounted on each shaft, the outboard ones being adjacent each belt means and the cams on adjacent shafts being out of longitudinal alignment, each cam having a generally spiral profile with a generally radially extending step interposed between the beginning and end of the spiral profile, said cam steps being oriented on their associated shafts to position said steps in said path sequentially in proceeding downstream.

11. A method for packing napkins or the like into a stack comprising advancing napkins in sequence along a longitudinally extending path into a packing station having a plurality of rotary cam means arranged both longitudinally and transversely above said path, each said cam means having a first peripheral portion in the direction of rotation adapted to lie above said path whereby a napkin can advance in said path without interference from said cam means and a second peripheral portion adapted to protrude into said path whereby said cam means are adapted to strip a napkin from a belt means which advances said napkin go said packing station and thereafter hold a stripped napkin in said magazine below said path, each cam means having a relatively abrupt transition between the end of said second peripheral portion and the beginning of said first peripheral portion, and sequencing the rotation of each said cam means to remove said transition from said path just prior to the time the leading edge of a napkin reaches each said cam means.

* * * * *